US006330920B1

(12) United States Patent
Wanner

(10) Patent No.: US 6,330,920 B1
(45) Date of Patent: Dec. 18, 2001

(54) MINE STRIPPER

(75) Inventor: Christopher J. Wanner, Stafford, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/493,126

(22) Filed: Jan. 28, 2000

(51) Int. Cl.[7] ..... F41H 11/12; F41F 3/02
(52) U.S. Cl. ..... 171/19; 171/46; 171/105
(58) Field of Search ..... 171/144, 143, 171/84, 86, 88, 91, 102, 104, 105, 106, 107, 110, 70, 46, 19

(56) References Cited

U.S. PATENT DOCUMENTS 2,738,633 * 3/1956 Bestland et al. ..... 171/105
2,763,975 * 9/1956 Weigel ..... 171/105
5,189,243 * 2/1993 Hambric ..... 171/105

* cited by examiner

*Primary Examiner*—Christopher J. Novosad
(74) *Attorney, Agent, or Firm*—Milton W. Lee; John E. Holford; Alain L. Bashore

(57) ABSTRACT

A mine stripper with numerous plow blades that rotate as they dig deeper to achieve an equilibrium depth of about nine inches and a basket that presses against the top of these blades to receive dislodged mines while sifting away attached soil.

6 Claims, 3 Drawing Sheets

MINE STRIPPER

BACKGROUND OF THE INVENTION

1. Field of the Invention

The present invention generally relates to plow or rake type mechanisms for removing mines within several inches of the earth's surface.

2. Description of Prior Art

In the past a quick method of breeching and/or clearing a mine field involved sweeping aside the topsoil layer with the blade of a bulldozer or an equivalent farm tractor and plow arrangement. The advantage of a bulldozer is that the heavy blade offers a high degree of protection for the operator, when a mine is accidentally detonated. To balance the constant pressure on the blade, it evolved into a vee shape for most mine removal operations. Some drawbacks to this equipment are that the plowing action still slows the operation considerably and the blade often buries itself slowing or stalling the tractor completely. It also leaves the mines in rows to be gathered in a separate operation.

SUMMARY OF THE INVENTION

An improved rake assembly is provided that allows the rake to seek an optimal depth without completely burrying itself. This is combined with a sifting basket to achieve full clearance of the mines.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
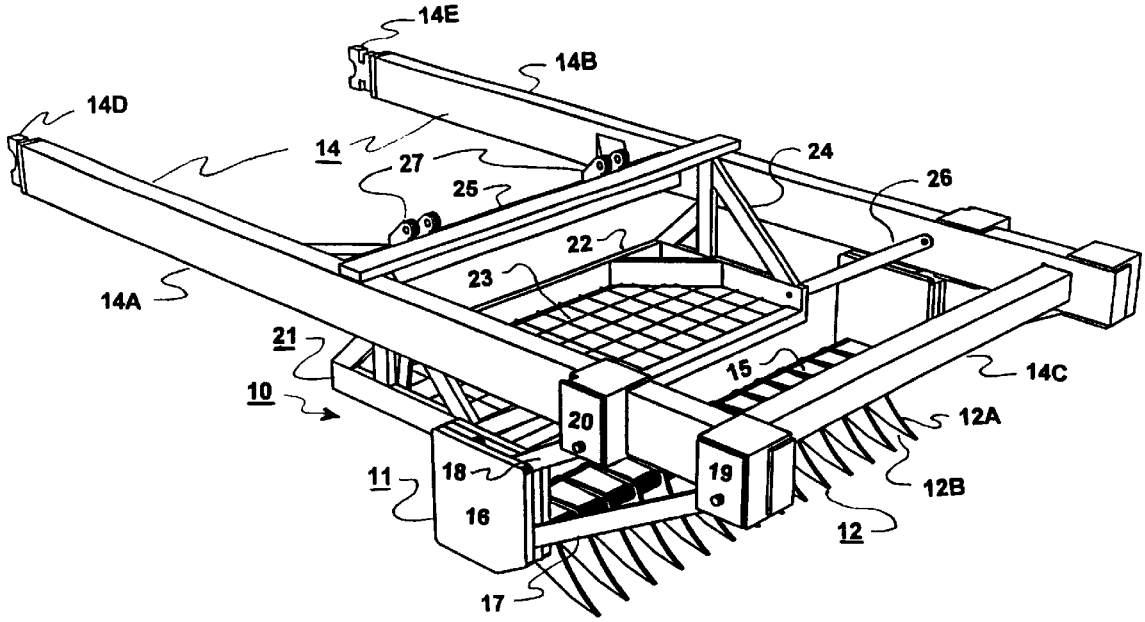
FIG. 1 is an isometric view of the mine rake assembly according to the present invention.

Referring now to the drawings, and more particularly to FIG. 1, there is shown an isometric view of a mine stripper 10 with a floating rake 11 having numerous blades 12, according to the present invention. The blades are attached together and supported on a U-shaped chassis 14. This chassis is defined by two parallel push bars 14A and 14B joined at their free end by a normal cross bar 14C. The opposite ends of the push bars include adapters 14D and 14E which may be attached to the tractor. The blades have a substantial thickness which is, however, only a small fraction of their spacing. They are also have curved top and bottom surfaces 12A and 12B that define an acute angle point at the bottom in front.

Figure 1A:
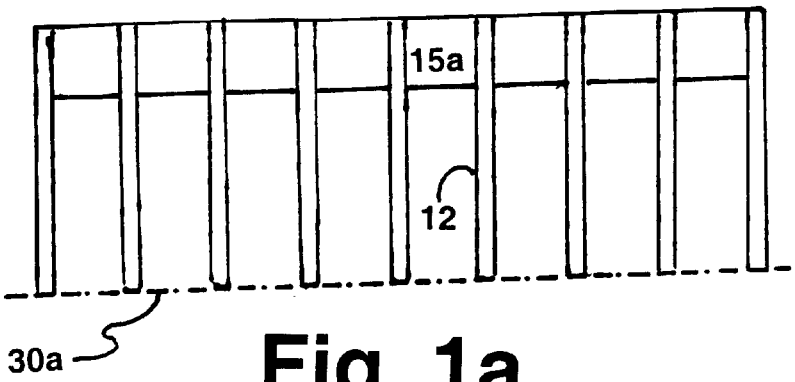
FIG. 1*a* is a top view of an arrangement of blades with insertion points that define an imaginary straight line segment normal to their push bars.

As shown more particularly in FIG. 1*a,* the blades may be joined by right angled separator blocks 15 *a* with rectangular horizontal cross-sections at the blade tops which maintain equal separation and angular position so that the blade points define an imaginary straight line segment 30*a* normal to the push bars.

Again as shown in FIG. 1, when attached rigidly to the push bar, the pointed ends touch the ground first and their weight plus the weight of the chassis on the top surfaces forces the blades into the ground as a direct function of resistance of the soil. Thus in hard soils the rake quickly buries itself and stalls the tractor pushing it. To prevent this applicant provides a rake pivot block 16 attached above each end of the rake with broad outside surfaces parallel to the inner and outer surfaces of the push bars. The vertical centerlines of these two blocks define a vertical rake plane that substantially bisects the separator blocks and blades. A separate long coupling bar 17 is attached at one end on the vertical center-line of each pivot block near the bottom edge. A separate short coupling bar 18 is similatly attached near the top edge of these blocks. The opposite end on each of the long coupling bars is attached to the outside surface of the nearest push bar by means of a front pivot block 19 at the free end of the push bar. The opposite ends of the small bars are similarly connected to the push bars by means of a rear pivot block 20 about midway horizontally between the nearest vertical center line and front pivot block. This creates a floating blade assembly. As the blades move away from the push bar, to bury themselves, the coupling bars rotate them to a less aggressive digging angle that prevents them from stalling the tractor.

Figure 1B:
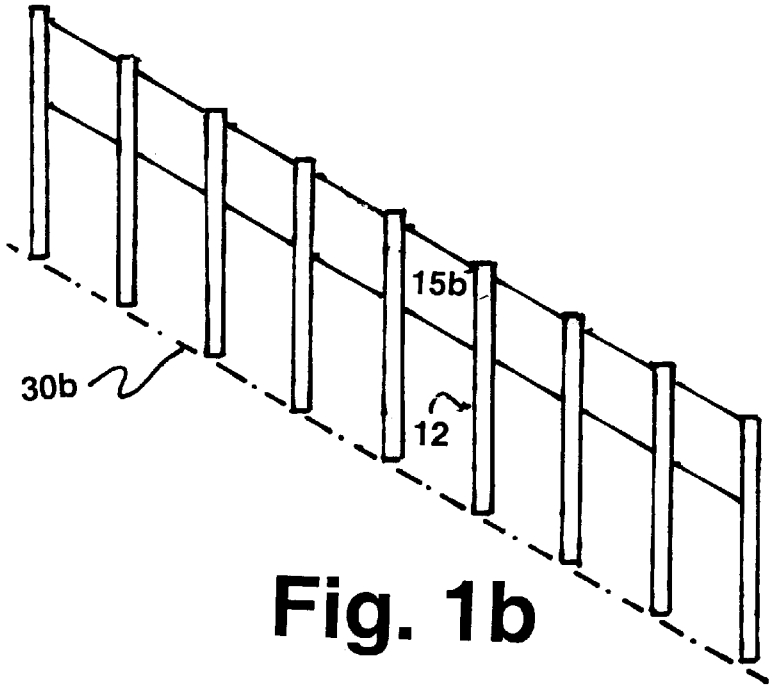
FIG. 1*b* is a top view of an arrangement of blades with insertion points that define an imaginary straight line segment slanted to their push bars.

As shown in FIG. 1*b,* the rake points may also be slanted by using equal acute angled separator blocks 15*b* with non-rectangular parallelogram cross-sections, in place of blocks 15*a*. The blade points then define an imaginary straight line segment 30*b* slanted with respect to the push bars. This slanted arrangement can move the displaced mines only to one side.

Figure 1C:
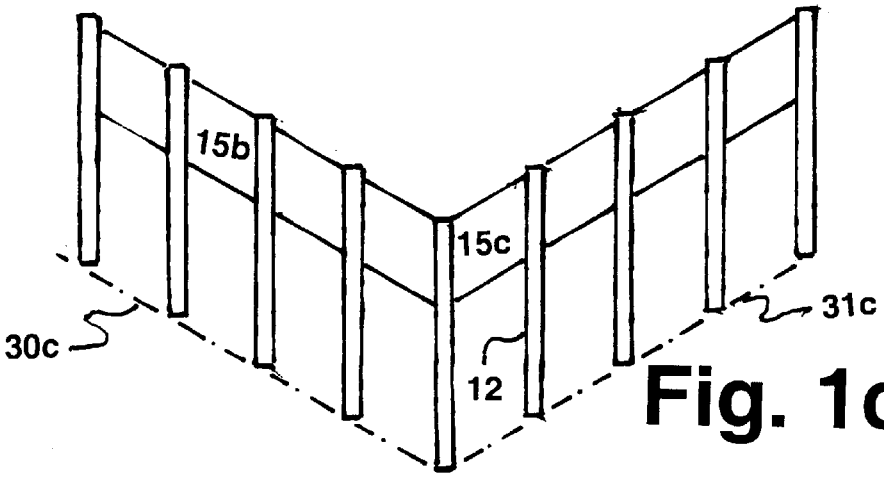
FIG. 1*c* is a top view of an arrangement of blades with insertion points that define two imaginary line segments forming a V-shape balanced with respect to their push bars.

As shown in FIG. 1*c,* about half of the same acute angle separators, like 15*c,* on one side of center can be inverted so that the blade points define two intersecting imaginary line segments 30*c* and 31*c* that define a V-shape to move mines into rows on both sides of a cleared path.

Returning to FIG. 1, a sifting basket 21 is also shown that collects mines uncovered by the rake. The basket consists of a rectangular metal frame 22 with a wide mesh metal fabric 23 drawn over and welded to its bottom. The long sides of the frame are slighlty less than spacing between the drawbars. A triangular brace 24 is attached to each of the small sides of the frame, the top of which freely slides against the nearest push bar. A skid bar 25 is attached to the top of the braces and extends over the pushbars to support the rear edge of the basket. Each of the front corners of the basket is supported by a swing bar 26, pivoted at that corner. The remote end of the swing bar is pivoted to the inside of the nearest draw bar slightly ahead of the rake plane. In operation the front edge of the basket gravitates against the back of the blade bar, so that mines cannot fall between them. The vibration of the blade bar as it digs is thus transmitted to the basket to enhance the the sifting action. To improve contact between the rake and the basket one or more jack bars 27 may be pivoted to the skid bar. These bars are connected to hydraulic jacks present on the D7 tractor. To direct all mines to the basket, when used, it is preferred that the tips of the blades be arranged as in FIG. 1*a*. An inverted vee arrangement of blocks 15*b* and 15*c* in FIG. 1*c,* however, might be used to better center the mines in the basket. The openings in the basket are small enough to prevent the smallest mines from lodging themselves, but large enough to freely pass loose soil and gravel. This arrangement produces less disturbance of the terrain immediately restoring it to use as roadway, farm or whatever the region requires.

Figure 2:
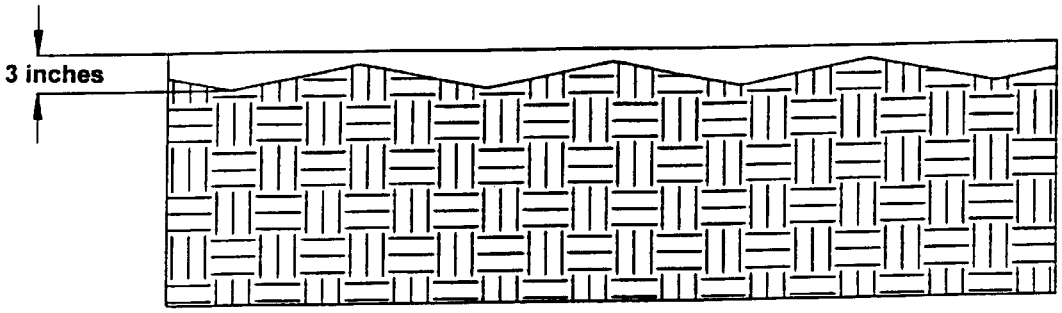
FIG. 2 is a graph of the raking profile of a standard military blade pushed by a D7 tractor.

FIG. 2 shows a typical plowing profile for a standard bulldozer blade. This standard blade on a D7 tractor is capable of plowing 3"–4" at 1 mph. However, the blade requires significant operator control to prevent stalling and results in a very non-uniform depth of cut, as shown.

Figure 3:
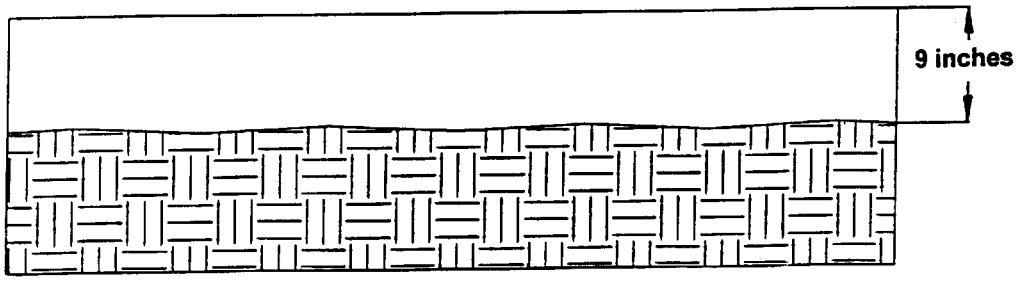
FIG. 3 is a graph of the raking profile of applicant's rake assembly pushed by the same D7 tractor.

FIG. 3 shows a typical plowing profile for applicant's floating blade assembly. Extended testing with this type of blade has demonstrated its outstanding performance at shearing soil and lifting mines when compared with standard plowing arraignments. Soil raking to a 9" depth was routinely performed at 1.5 mph without operator control of the blade. To perform realistic tests with safety, the tractor was equipped with remote control and operated in existing mine fields without a driver.

While this invention has been described in terms of a preferred embodiment consisting of a floating blade assembly and sifting basket for a D7 tractor, those skilled in the art will recognize that the invention can be practiced with modification within the spirit and scope of the appended claims.

Having thus described my invention, what I claim as new and desire to secure by Letters Patent is as follows:

1. A mine stripper with at least one pushbar for attachment to a tractor and a blade bar mounted transversely under said pushbar, said blade bar including:

a series of thin flat rake blades with forward and downwardly directed points, said blades being parallel to a first vertical plane through the longitudindal central axis of said pushbar and joined by separator blocks so that said points define no more than two imaginary straight horizontal lines transverse to said pushbar; and means to mount said blades for limited vertical movement away from said pushbar and for rotating said blade bar about an axis normal to said first plane in direct proportion to the amount of said movement, in a direction such that the angle of attack of said points from horizontal is reduced.

2. A mine stripper according to claim 1, having two parallel pushbars; and wherein:

said blade bar has a similar mounting at each end to each of said pushbars;

said mountings comprising two coupling bars of different lengths, each of said coupling bars being pivoted at one end to spaced points along said pushbar and at the other end to spaced points across said blade bar.

3. A mine stripper according to claim 1; further including:

a sifting basket behind said blades slidably mounted at its rear end on said pushbars with its front end hanging by a pair of swing bars pivoted on said pushbars over and in front of said blades, whereby said basket gravitates toward the back of said blades to catch and sift mines, soil, rocks and any other objects buried in the soil passing over said blades while picking up vibration from said blades.

4. A mine stripper according to claim 1; wherein:

said points define a single horizontal imaginary line normal to said first vertical plane.

5. A mine stripper according to claim 1; wherein:

said points define a single horizontal imaginary line at an acute angle to said first vertical plane.

6. A mine stripper according to claim 1; wherein:

said points define two horizontal imaginary lines intersecting in the center of said blade bar at approximately the same but opposite acute angles to said first vertical plane thereby defining a balanced V-shaped line.

* * * * *